US005170592A

United States Patent [19]

Boulton

[11] Patent Number: 5,170,592

[45] Date of Patent: Dec. 15, 1992

[54] HONING STONE AND GUIDE ASSEMBLIES

[76] Inventor: Michael A. Boulton, Broadlands New Road, Woodmancote NR Cheltenham, England

[21] Appl. No.: 635,207

[22] Filed: Dec. 28, 1990

Related U.S. Application Data

[63] Continuation-in-part of Ser. No. 386,589, Jul. 31, 1989, abandoned.

[51] Int. Cl.[5] ..... B24B 9/00

[52] U.S. Cl. ..... 51/331; 51/339; 51/350; 51/204

[58] Field of Search ..... 51/330, 331, 339, 345, 51/347, 350, 204

[56] References Cited

U.S. PATENT DOCUMENTS

| | | | |
|---|---|---|---|
| 3,403,481 | 10/1968 | McDonald | 51/204 |
| 3,822,515 | 7/1974 | Gillette | 51/204 |
| 4,291,506 | 9/1981 | Kramm | 51/338 |

*Primary Examiner*—M. Rachuba
*Attorney, Agent, or Firm*—Jon L. Roberts

[57] ABSTRACT

A honing stone and guide assembly is described comprising an abrasive honing stone bonded to a plastics shoe. The shoe is a snap fit on the platform of a stone holder. A similar plastic snap-on honing guide fits a platform of a guide holder.

22 Claims, 6 Drawing Sheets

FIG. 1
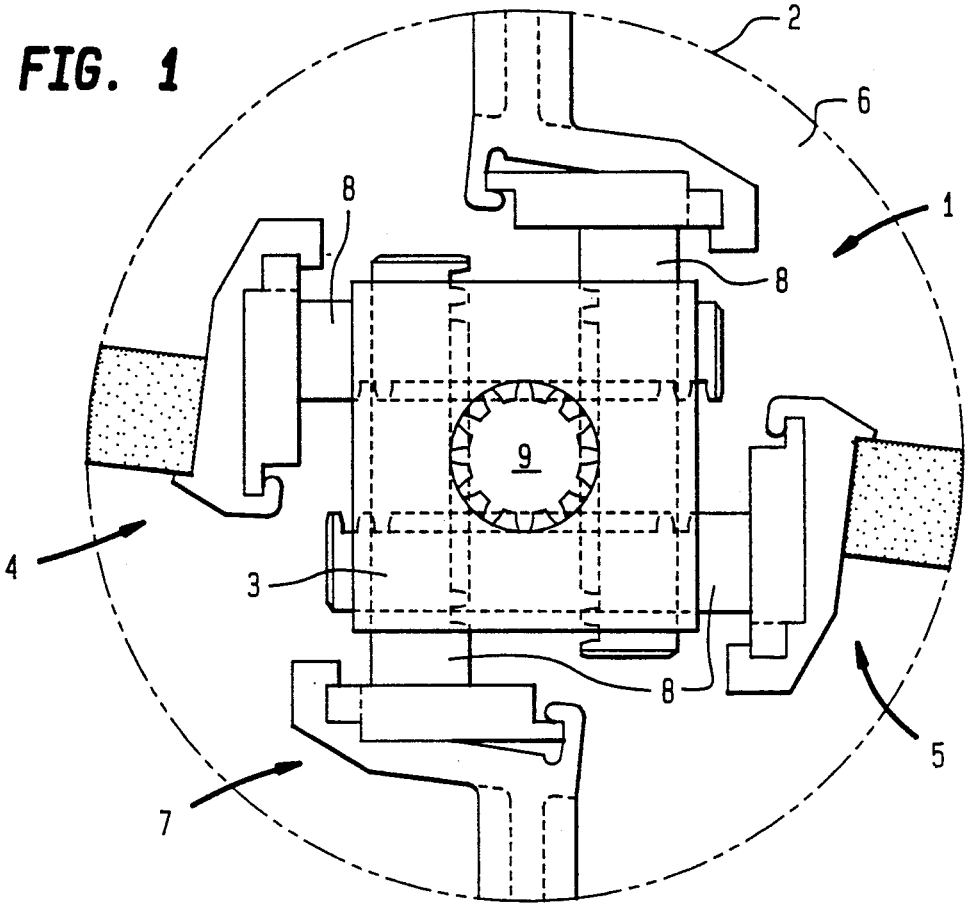
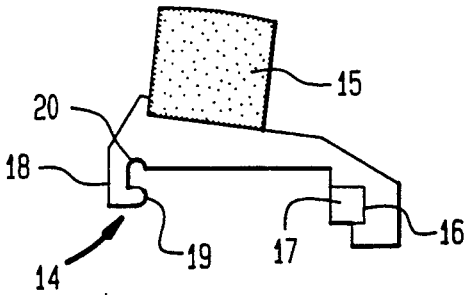
FIG. 5
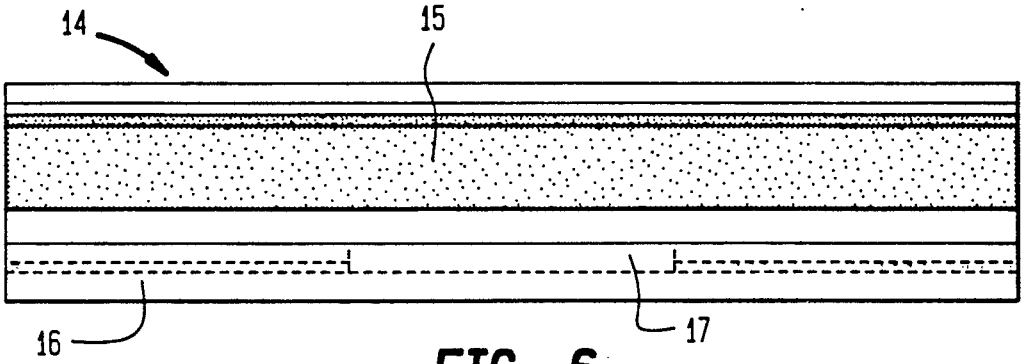
FIG. 6

HONING STONE AND GUIDE ASSEMBLIES

BACKGROUND OF THE INVENTION

This application is a Continuation in Part of Application Ser. No. 07/386,589 filed Jul. 31, 1989, (now abandoned); Inventor, Michael Andre Boulton. The invention relates to honing assemblies and in particular to the mounting of honing stones and the construction and mounting of honing guides.

PRIOR ART

In honing a bore, abrasive honing stones are mounted on a honing mandrel to be radially urged against the wall of the bore as the mandrel is rotated. Usually a pair of honing stones is urged outwardly in opposition. In order to prevent noise and chattering and generally to assist in maintaining bore roundness it is found necessary to provide guides that are disposed between the honing stones and urged resiliently from the mandrel against the wall of the bore. The guides are non-abrasive and should preferably wear at approximately the same rate as the stones.

The stones and guides must be replaced when they have worn to a certain extent. Existing arrangements for replacing stones and guides have disadvantages. The present invention seeks to provide improvements in the construction and mounting of honing stones and guides that not only facilitate replacement but also reduce the cost of the replacement stones and guides.

SUMMARY OF THE INVENTION

According to one aspect of the invention, there is proved, in combination: (1) a honing stone holder comprising a pair of legs and a platform mounted on said legs and having a first edge thereon; and (2) a honing stone assembly comprising a honing stone and a plastic shoe bonded to said honing stone and having an elongated rebate in said shoe for accommodating said first edge of said platform, said shoe having a shape and an inherent resilience for being a snap fit on said platform.

Honing generates a significant amount of heat, and it is to be understood that the plastic material of the shoe should be selected accordingly. As used herein "plastic" means a crosslinked or vulcanized plastic or elastomer material, which includes silicones and resins such as phenolic and melamine resins. For example, cross-linking may be applied to the following groups of materials: polyamides, polyethylenes, polypropylenes, polyurethanes, and polyvinylacetates. A suitable group of materials are acetals and polyacetals. Glass-filling may be used to enhance the properties of the material.

The stone may be bonded directly or via a metal shell (of steel, for example) to the plastic shoe. Bonding may be accomplished by using suitable adhesives or by fusing, welding, or molding the shoe directly onto the stone or shell (after priming or plating, for example).

The shoe may be provided with upstanding end stops between which the stone is fitted, the ends stops being effective to assist in holding the stone against longitudinal movement with respect to the shoe. The legs may be serrations that constitute a rack for cooperation with a pinion in the mandrel, whereby the stone holders may be moved radially with respect to the bore being honed.

Preferably, the shoe has an elongate rebate that accommodates one edge of the platform, and the other edge of the platform constitutes a ledge to retain the opposite side of the shoe. A preferred arrangement is that the shoe on said opposite side has a depending wall with an inwardly projecting rib at its extremity, the wall being flexible enough to allow the rib to be forced over the ledge, whereby it is retained.

It is necessary to locate the shoe on the holder against longitudinal movement. One arrangement is to provide a rebate in the first-mentioned edge of the platform and in the co-operating key shape in the shoe. In another arrangement the shoe has ends that embrace the ends of the platform, the platform effectively sitting within a recess in the shoe.

Another, and preferred, arrangement is to provide the platform with a slot or a plurality of holes, the slot or holes having said first edge with which the rebated portion of the holder cooperates. In this way the ends of the slot or holes provide location against longitudinal movement. This arrangement has the advantage that it is easier to make the shoe from a plastic extrusion so that molding techniques are avoided. This renders fabrications easier and reduces costs.

The provision of a plastic shoe of the kind described allows simple snap-on, snap-off replacement of worn stones. The time-consuming rivetting or screwing of replacement shoes in a conventional arrangement is obviated. Also, the manufacture of replacement shoes is simplified and made significantly less expensive by the use of moulded or extruded plastic rather than cast metal, as hitherto.

Another aspect of the invention relates to honing guides, and in accordance herewith there is provided in combination: (1) a guide holder for a honing guide comprising a pair of legs and a platform mounted on said legs and having a first edge thereon; and (2) a honing guide made of plastic and having an elongated rebate for accommodating said first edge of said platform, said guide having a shape and an inherent resilience for being a snap fit on said platform. The platform may be identical with the above-described platform for the stone holder and the legs similarly identical. It must be observed, however, that if the stone holders and guide holders are to be used in the same mandrel, the disposition of the legs on the platforms must be respectively different so that the legs of the stone holders do not interfere with the legs of the guide holders.

Because the platforms of the stone holders and guide holders are preferably identical, the provision of similar rebate, wall, rib, and key will be understood to apply to the guide and holder combination. However, the preferred configuration of the guide differs in a significant respect from the configuration of the stone shoe: the guide is to be resiliently urged against the wall of the bore whereas there is no similar resilience for the shoe. Thus, the base of the shoe is flat against the platform. On the other hand, a feature of the present invention provides an inclined base region for the guide whereby a gap is provided beneath the guide and the body of the guide constitutes a leaf spring to provide the necessary resilience. It is to be noted that the leaf spring provided by this arrangement extends over the full length of the guide and not merely locally as in prior arrangements. The plastics material is suitably selected, preferably being an acetal material, and may be loaded with other material (carbon fiber or glass fiber, for example) to give the required strength and resilience. The guide may be differentially loaded with selected material so as to give pre-selected wear characteristics at its wear face while retaining required resilience at the spring region and strength at the rebate, for example.

DESCRIPTION OF THE DRAWINGS

The invention will further be described with reference to the accompanying drawings, of which:

FIG. 1 is a schematic plan view of a honing mandrel embodying the invention;

FIG. 5 is an end elevation of a stone shoe for fitting the holder of FIG. 2 to 4;

FIG. 6 is a plan view of the shoe of FIG. 5;

DESCRIPTION OF THE PREFERRED EMBODIMENTS

Figure 2:
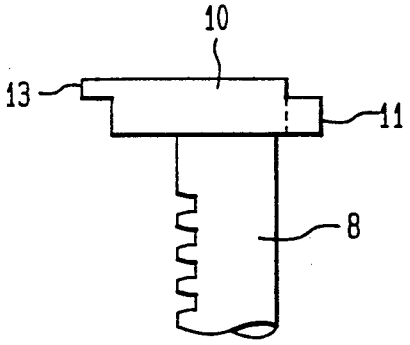
FIG. 2 is an end elevation of a stone holder of FIG. 1.

Referring to FIG. 1, the mandrel 1 is inserted into the bore 2 of a cylinder to be honed. A block 3 carries two honing stone units 4 and 5 and two guide units 6 and 7. Each of the units is mounted on a pair of legs 8 that have serrations that constitute racks that mesh with a pinion 9. The stone and guide units are urged outwardly by rotation of the pinion and honing is effected by rotation of the pinion and honing is effected by rotation of the mandrel as a whole with respect to the cylinder and by stroking the mandrel longitudinally with respect to the cylinder.

Figure 3:
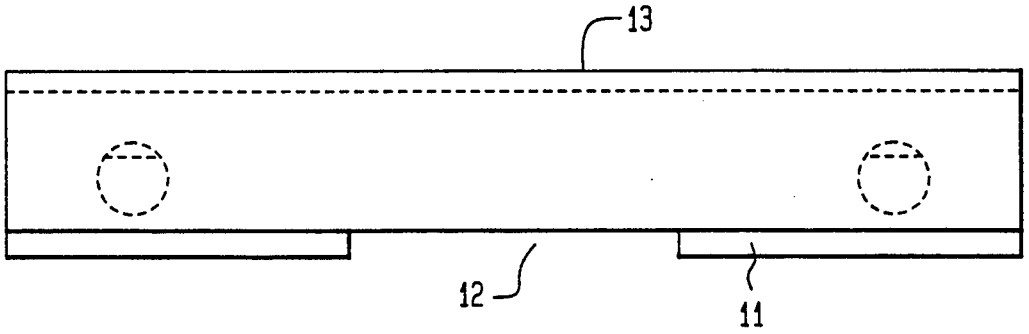
FIG. 3 is a plan view of the stone holder of FIG. 2.
Figure 4:
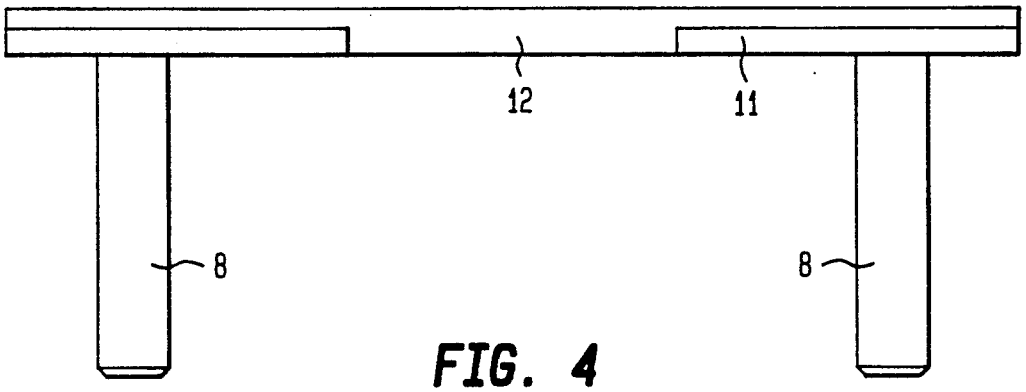
FIG. 4 is a side elevation of the stone holder of FIG. 2.

FIGS. 2 to 4 show a stone holder having legs 8 mounted on a platform 10. The platform has an edge 11 that has a central rebate 12 (FIG. 3) to constitute a key. The platform has a ledge 13 opposite the edge 11.

FIG. 5 and 6 show a shoe 14 made of moulded acetal material and having bonded to it an abrasive honing stone 15. Bonding is effected by the use of Loctite Prism 757 primer in conjunction with Loctite Prism 406 adhesive. The shoe is shaped to have a rebate 16 that accommodates the edge 11 of the platform. The rebate has a key portion 17 that fits the rebate 12 to key therewith and prevent longitudinal movement of the shoe with respect to the platform.

The shoe has a depending wall 18 with an inwardly facing curved-section rib 19. A slot 20 aids the flexing of the wall so that the shoe may be snapped on to the platform by forcing the rib beyond the ledge 13. The shoe can thus be snapped on and off the platform.

Figure 7:
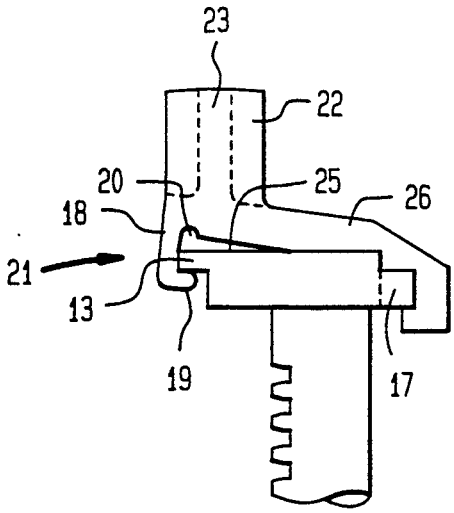
FIG. 7 is an end elevation of a guide of the mandrel of FIG. 1.
Figure 8:
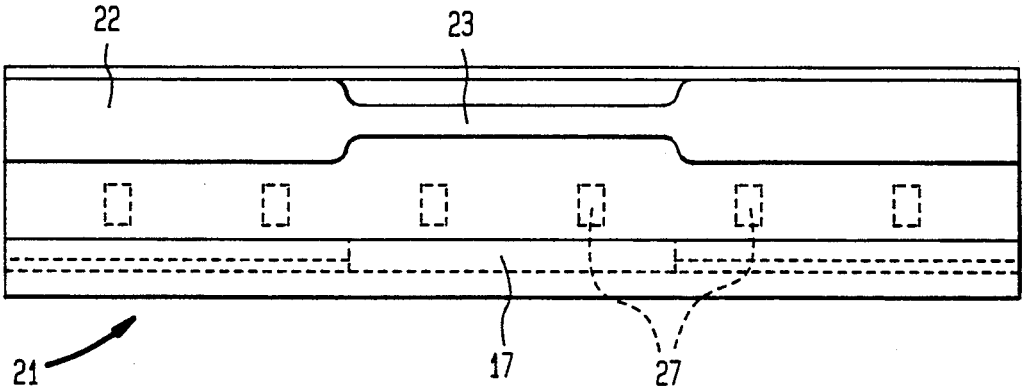
FIG. 8 is a plan view of the guide for FIG. 7.

Referring now to FIGS. 7 and 8, there is shown a honing guide in accordance with the invention. The guide 21 is made of plastics and has a rebate, a key shape 17, a depending wall 18, a rib 19, and a slot 20 whereby the guide can be a snap fit on a platform in the same manner as the shoe of FIGS. 5 and 6. The guide has an upstanding wear block 22 that bears against the wall of the cylinder. The block is shaped with a central neck 23 as shown in FIG. 8.

An important feature of the guide is the shape of its base at 24, where it is angled to provide a gap 25 beneath it. Portion 26 of the guide thus constitutes a leaf spring to give resilience to the action of the wear block on the bore wall. It will be appreciated that the rib 19 is allowed to ride down beyond the ledge 13 of the platform.

Figure 9:
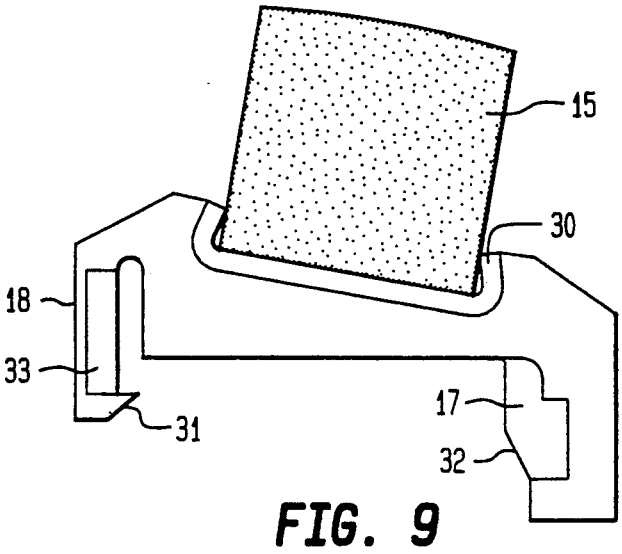
FIG. 9 is an end elevation of another honing stone assembly embodying the invention.

FIG. 9 shows an alternative shoe for the honing stone assembly. Instead of being bonded directly to the shoe, the stone 15 is bonded to a reinforcing steel shell 30, which itself is bonded to the shoe. Bonding is effected by adhesives as described above.

The shape of the shoe differs in some respects from that of the shoe and guide described above. For example, the rib 19 of the above described shoe is replaced by an angled member 31 having a wedge shape. The key 17 has an angle at 32. At each end, the wall 18 has a 10° angle shown at 33. It is to be understood that a corresponding guide also has these characteristics.

Figure 10:
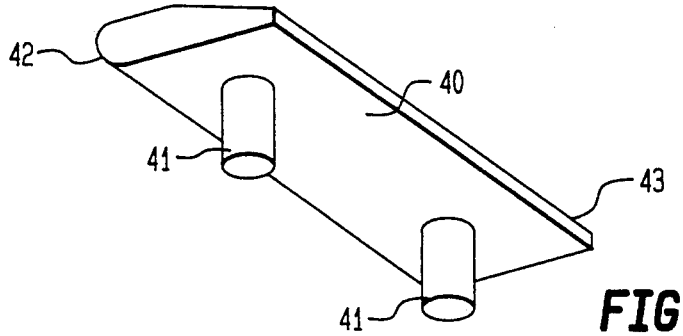
FIG. 10 is a perspective view of another shape of platform for use in the invention.

Referring now to a FIG. 10, there is shown a platform 40 with legs 41. One edge 42 of the platform is rounded and the opposite edge 43 is square. There is no rebate 12 as in FIGS. 3 and 4. Instead, longitudinal movement of the shoe or guide on the platform is prevented by end pieces.

Figure 11:
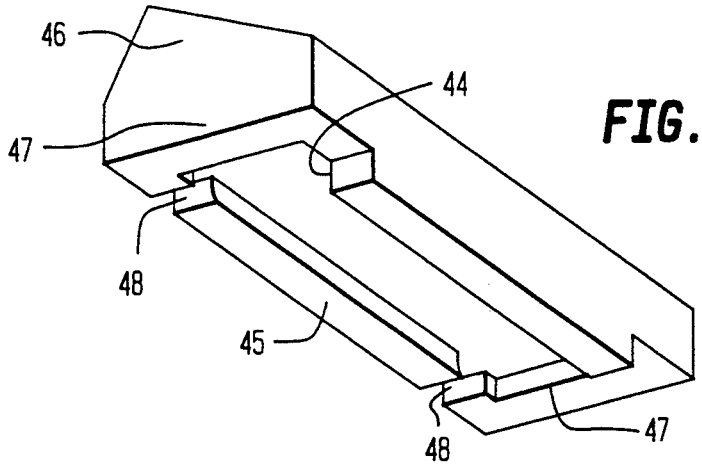
FIG. 11 is a perspective view of a shoe for fitting the platform of FIG. 10.
Figure 12:
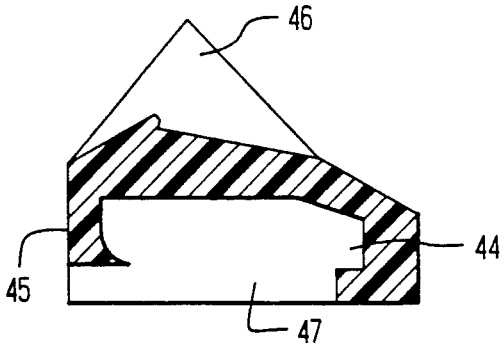
FIG. 12 is a sectional view taken at XII—XII of FIG. 11.
Figure 13:
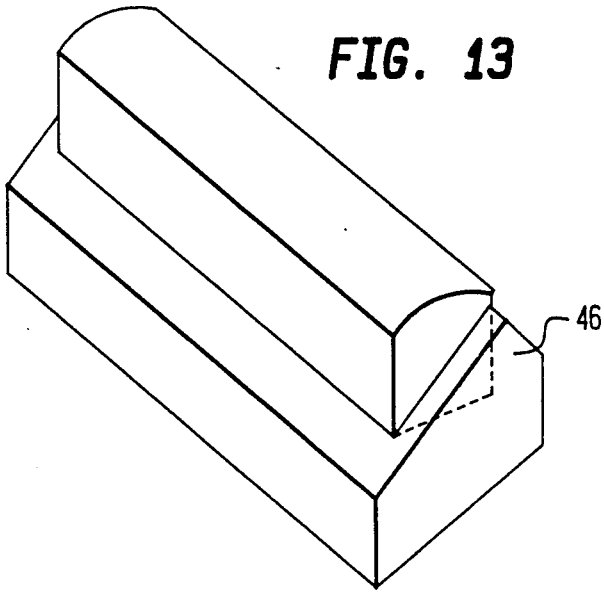
FIG. 13 is a perspective view of the shoe of FIG. 10 with a honing stone in place.

A suitable shoe is shown in perspective in FIG. 11 and in cross-section in FIG. 12. A rebate 44 accommodates edge 43 and a snap fit over the rounded edge 42 is ensured by a suitably shaped section 45. Upstanding end pieces 46 secure the stone 47 (FIG. 13) against longitudinal movement with respect to the shoe. The stone is secured in place with suitable adhesive. End webs 47 ensure that the shoe does not move longitudinally on the platform. Cut-outs 48 allow the section 45 to flex for snap fitting.

Figure 14:
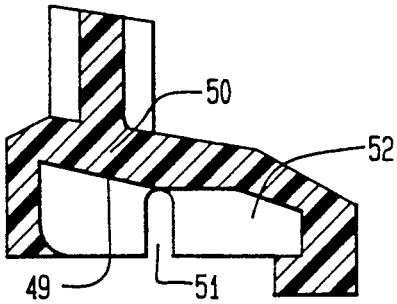
FIG. 14 is a cross-sectional view of a guide for fitting a guide platform of the same shape as the stone platform of FIG. 10.

FIG. 14 shows a plastic guide suitable for a platform of the shape shown in FIG. 10. As with the previously described embodiment, the lower face of the guide is provided with an angle at 49 so that there is a gap with respect to the platform. Part 50 of the guide constitutes a leaf spring, and flexing is allowed by cut-outs 51 in the end webs 52. Otherwise, it is to be understood that the structure of the guide is similar to that of the shoe of FIGS. 11 to 13.

Figure 15:
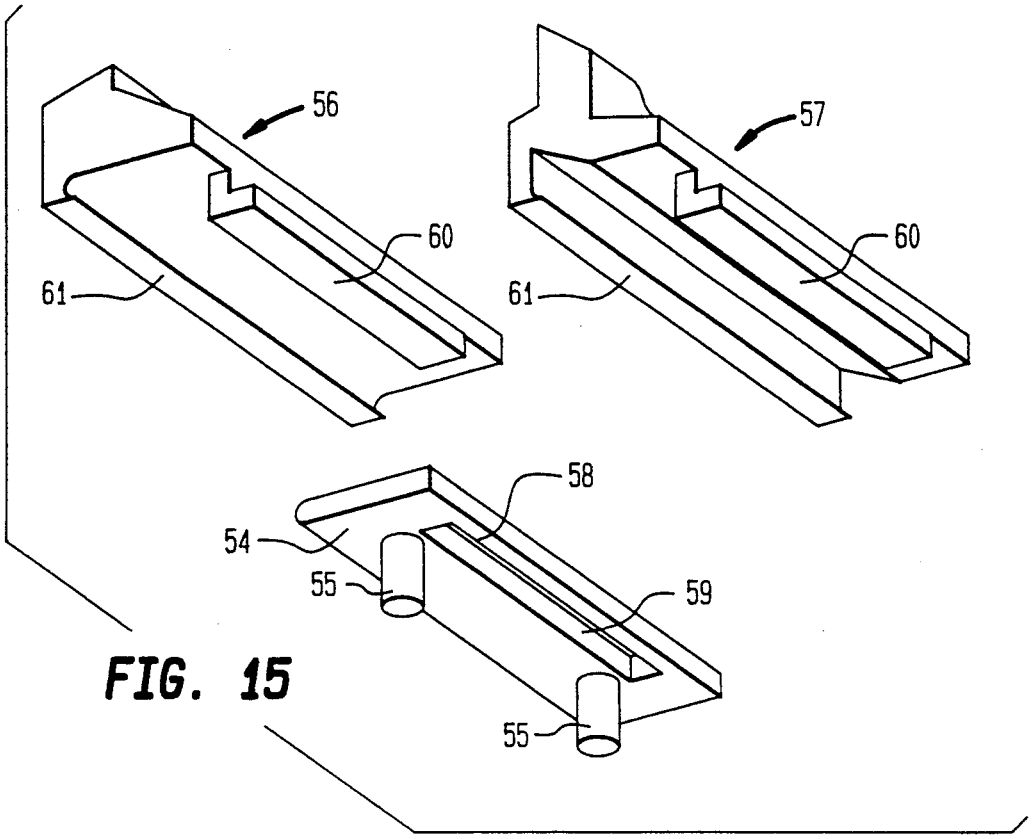
FIG. 15 is a perspective view of a slotted platform and associated shoe and guide.

FIG. 15 is a three-part figure showing a platform 54 with legs 55, a shoe 56, and guide 57 suitable for fitting the platform. Here there is a difference from the previously described embodiments in that the edge of the platform with which the shoe or guide cooperates is the edge 58 of a slot 59 in the platform. The shoe and guide have an elongate rebate formed at a depending section 60 that is hooked into the slot. Snap-fitting is achieved as in the embodiment of FIGS. 10 to 14 by a curved flexible section 61 that fits the curved edge of the platform.

Figure 16:
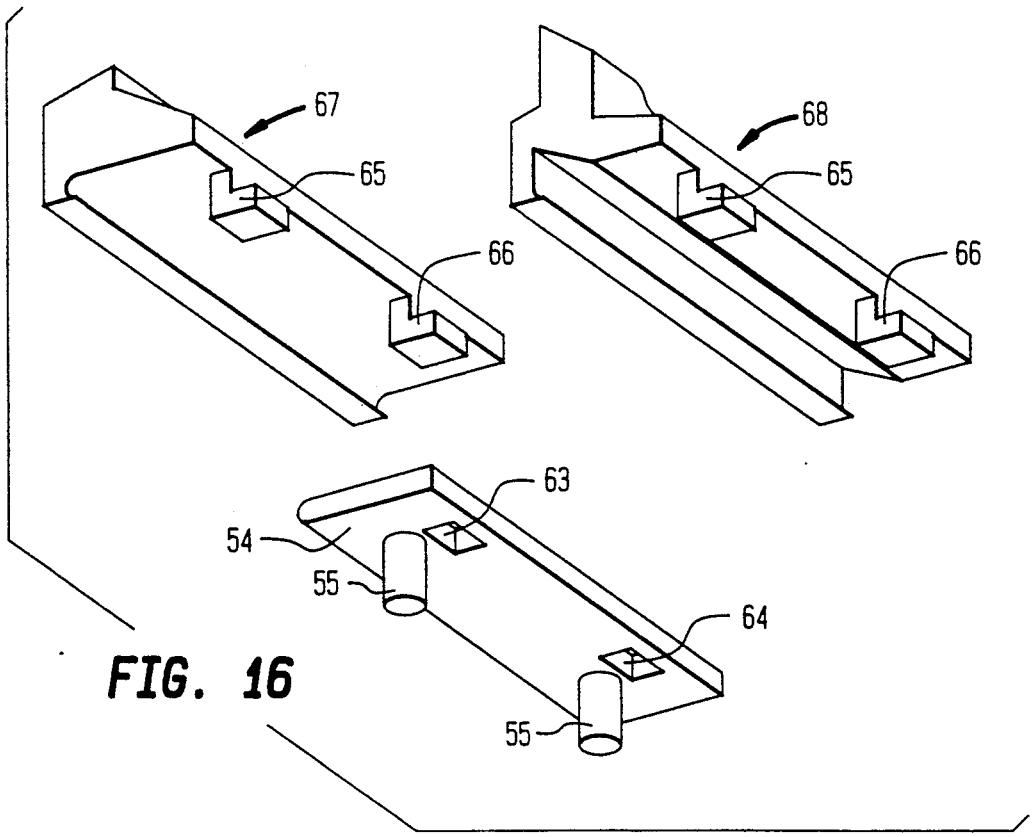
FIG. 16 is a perspective view of a platform with holes and associate shoe and guide.

FIG. 16 shows a modification of the FIG. 15 arrangement where the slot 59 of FIG. 15 can be regarded as discontinuous in that two square holes 63, 64 are provided in the platform. Two rebated pegs 65, 66 on the shoe 67 or guide 68 provide location in the holes and allow a snap-fit. It will be appreciated that the hooks presented by the section 60 of FIG. 15 or the pegs 65, 66 of FIG. 16 can be formed alternatively in the reverse way to be inwardly facing instead of outwardly facing.

Figure 17:
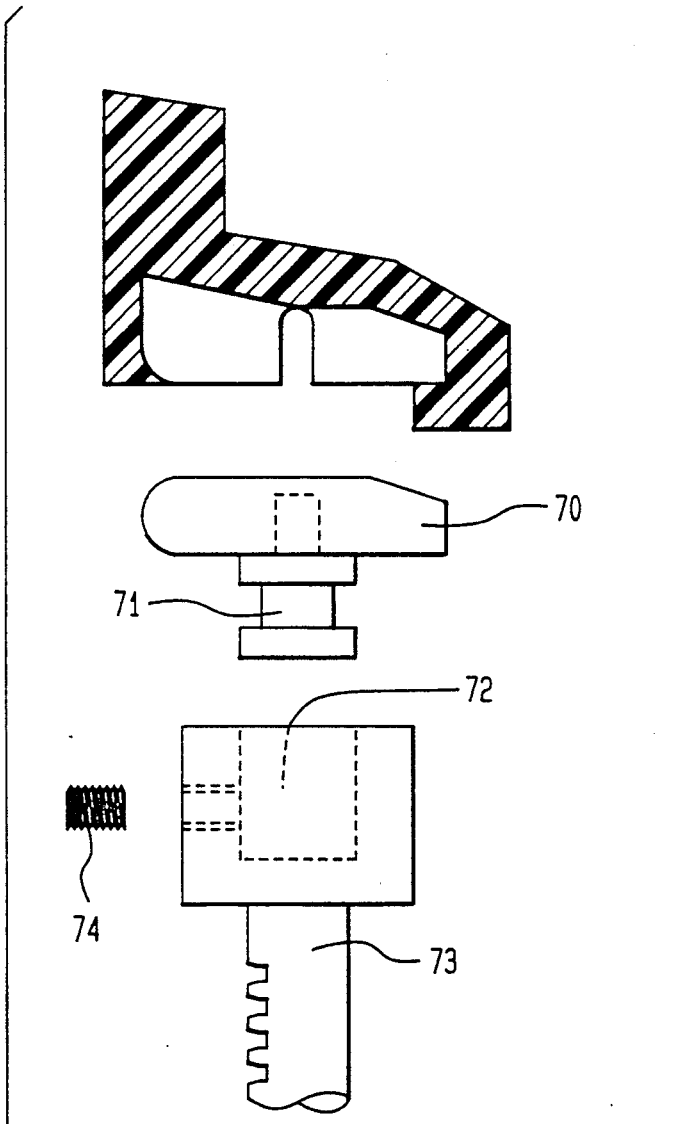
FIG. 17 is a diagram of a honing stone assembly in accordance with the invention in which the platform is detachable from the legs.

FIG. 17 shows an arrangement in which the serrated legs for the platform are detachable. Thus, the platform 70 has grooved pegs 71 that are received in chambers 72 in the tops of the legs 73. Grub-screws 74 hold the legs on the platform.

The invention is not restricted to the details of the embodiments described above with reference to the drawings. For example, the guide of FIGS. 7 and 8 could be modified by the provision of slots of chosen size and spacing (perhaps varied along the length of the guide) to adjust the guide characteristics. Exemplary slots are shown in broken line at 27. Similarly a slot or slots could be provided in wall 18 if required.

Furthermore, ledge 13 could be provided with a cut-out of a similar nature to cut-out 12 in edge 11. This additional cut-out would cooperate with a key portion on the shoe similar to key portion 17 and would give additional support against the effect of longitudinal forces exerted on the shoe. Other primes and adhesives may be used.

What I claim is:

1. In combination: (1) a honing stone holder comprising a pair of legs and a platform mounted on said legs and having a first edge thereon; and (2) a honing stone assembly comprising a honing stone and a plastic shoe bonded to said honing stone and having an elongated rebate in said shoe for accommodating said first edge of said platform, said shoe having a shape and an inherent resilience for being a snap fit on said platform.

2. The combination as claimed in claim 1 wherein the platform has a slot therein and said first edge is an edge of said slot.

3. The combination as claimed in claim 1 in which said shoe has a depending wall on the side opposite said rebate and an inwardly projecting rib at the extremity of said wall, and said platform has a second edge that constitutes a ledge opposite said first edge, said wall being sufficiently flexible to allow said rib to be forced over said ledge for producing the snap fit, said shoe being thereby retained on said platform.

4. The combination as claimed in claim 1 wherein said first edge of said platform has a key shape and said rebate in said shoe has a shape that cooperates with said key shape to prevent relative longitudinal movement of said shoe with respect to said platform.

5. In combination: (1) a honing stone holder comprising a pair of legs and a platform mounted on said legs and having a plurality of holes therein, each hole having a first edge; and (2) a honing stone assembly comprising a honing stone and a plastic shoe bonded to said honing stone and having rebated portions insertable in said holes for accommodating said first edges thereof, said shoe having a shape and an inherent resilience for being a snap fit on said platform.

6. A honing stone assembly for being removably mounted on a honing stone holder having a pair of legs and a platform on said legs having a first edge thereon, said honing stone assembly comprising a honing stone and a plastic shoe bonded to said honing stone and having an elongated rebate therein, said shoe having a shape and inherent resilience for being a snap fit on said platform with said elongated rebate accommodating the first edge of the platform.

7. A honing stone assembly as claimed in claim 6 in which said shoe has a depending wall on the side opposite said rebate and an inwardly projecting rib at the extremity of said wall.

8. A honing stone assembly as claimed in claim 6 in which said rebate is a key-shaped rebate that cooperates with a key shape on the platform to prevent relative longitudinal movement of the shoe with respect to the platform.

9. A honing stone assembly as claimed in claim 6 in which said honing stone is bonded directly to said shoe.

10. A honing stone assembly as claimed in claim 6 further comprising a metal shell bonded directly to said shoe, said honing stone being held in said metal shell.

11. A honing stone assembly as claimed in claim 9 or claim 10 in which the bonding is effected by the use of Loctite Prism 757 primer in conjunction with Loctite Prism 406 adhesive.

12. A honing stone assembly as claimed in claim- 1 wherein said shoe is provided with upstanding end stops between which said honing stone fits, the end stops being effective to assist in holding the stone against longitudinal movement with respect to the shoe.

13. In combination: (1) a guide holder for a honing guide comprising a pair of legs and a platform mounted on said legs and having a first edge thereon; (2) and a honing guide made of plastic and having an elongated rebate for accommodating said first edge of said platform, said guide having a shape and an inherent resilience for being a snap fit on said platform.

14. The combination as claimed in claim 13 wherein the platform has a slot therein and said first edge is an edge of said slot.

15. The combination as claimed in claim 13 in which said guide has a depending wall on the side opposite said rebate and an inwardly projecting rib at the extremity of said wall, and said platform has a second edge that constitutes a ledge opposite said first edge, said wall being sufficiently flexible to allow said rib to be forced over said ledge for producing the snap fit, said guide being thereby retained on said platform.

16. The combination as claimed in claim 13 wherein said first edge of said platform has a key shape and said rebate in said guide has a shape that cooperates with said key shape to prevent relative longitudinal movement of said guide with respect to said platform.

17. In combination: (1) a guide holder for a honing guide comprising a pair of legs and a platform mounted on said legs and having a plurality of holes therein, each hole having a first edge; and (2) a honing guide made of plastic and having rebated portions insertable in said holes for accommodating said first edges thereof, said guide having a shape and an inherent resilience for being a snap fit on said platform.

18. A honing guide for being removably mounted on a honing guide holder having a pair of legs and a platform on said legs having a / first edge thereon, said guide being made of plastic and having an elongated rebate for accommodating an edge of the guide holder platform, said guide having a shape and inherent resilience for being a snap fit on said platform.

19. A honing guide as claimed in claim 18 in which said guide has an inclined base region for providing a gap beneath the guide when it is mounted on the guide holder, the body of said guide constituting a leaf spring for providing resilience.

20. A honing guide as claimed in claim-18 in which said guide has a depending wall on the side opposite said rebate and an inwardly projecting rib at the extremity of said wall.

21. A honing guide as claimed in claim 18 in which said rebate is a key-shaped rebate that cooperates with a key shape on the platform to prevent relative longitudinal movement of the guide with respect to the platform.

22. A honing guide for being mounted on a honing guide holder having a pair of legs and a platform on said legs, said guide being made of plastic and having a shape and resilience for being a snap fit on said platform, the guide having an inclined base region for providing a gap beneath the guide when it is mounted on the guide holder, and the body of the guide constituting a leaf spring for providing resilience.

* * * * *